US007909007B2

(12) United States Patent
Manther et al.

(10) Patent No.: US 7,909,007 B2
(45) **Date of Patent: *Mar. 22, 2011**

(54) ROLLER FINGER FOLLOWER FOR VALVE DEACTIVATION

(75) Inventors: Debora Manther, Royal Oak, MI (US); Yunshan Liu, Rochester Hills, MI (US); Anna Strehlau, Windsor (CA); Richard Best, Orem, UT (US); Xiaopo Ma, Troy, MI (US)

(73) Assignee: Schaeffler KG, Herzogenaurach (DE)

( * ) Notice: Subject to any disclaimer, the term of this patent is extended or adjusted under 35 U.S.C. 154(b) by 298 days.

This patent is subject to a terminal disclaimer.

(21) Appl. No.: 12/328,285

(22) Filed: Dec. 4, 2008

(65) Prior Publication Data

US 2009/0114177 A1 May 7, 2009

Related U.S. Application Data

(63) Continuation-in-part of application No. 12/132,232, filed on Jun. 3, 2008.

(60) Provisional application No. 60/941,732, filed on Jun. 4, 2007.

(51) Int. Cl.
*F01L 1/34* (2006.01)

(52) U.S. Cl. ..... 123/90.16; 123/90.39; 123/90.44

(58) Field of Classification Search ..... 123/90.39, 123/90.44, 90.41, 90.42, 90.43, 90.45, 90.16
See application file for complete search history.

*Primary Examiner* — Thomas E Denion
*Assistant Examiner* — Daniel A Bernstein
(74) *Attorney, Agent, or Firm* — Lucas & Mercanti, LLP

(57) ABSTRACT

The finger follower has an inner and outer body and a torsional lost motion spring positioned at its lash adjuster end of the outer body. The torsional lost motion spring has two helical parts each with a short leg that abuts the outer body and a long leg that contacts the inner body. The torsional spring is located above the pivot point of the finger follower so as to provide a low mass moment of inertia and to reduce the weight over the valve stem end of the follower.

13 Claims, 6 Drawing Sheets

ROLLER FINGER FOLLOWER FOR VALVE DEACTIVATION

FIELD OF INVENTION

The invention relates to roller finger followers that are used in overhead cam type internal combustion engines and, more particularly, to switchable roller finger followers that have a high lift, low lift, and no lift mode.

BACKGROUND OF THE INVENTION

Switchable roller finger followers that have a high lift mode, a low lift mode, and a no lift mode are known. Typically, such finger followers have an outer elongated body, one end of which mates with a valve stem and operates on the valve stem, and a second end which is in contact with a hydraulic lash adjuster. An inner elongated body is centrally located in the outer elongated body and houses a cam follower that is operated on by the cam so as to provide motion to the finger follower. The inner elongated body has two modes, a locked mode and an unlocked mode. A latching mechanism is part of the finger follower and is used to lock the inner elongated body in a stationary position. When the inner elongated body is locked in a stationary position, the cam which is fixed to the cam shaft of the engine forces the movement of the finger follower which translates into the movement of the valve through the valve stem. In order to deactivate the finger follower, the latch is released and the inner elongated body is unlocked and can travel freely up and down in conjunction with the cam without transferring the motion of the cam to the finger follower.

In order to maintain contact between the cam and the cam follower during the unlocked periods, a lost motion spring is employed. A typical lost motion spring is either helical or torsional.

OBJECT OF THE INVENTION

It is the object of the invention to design a switchable roller finger follower for an overhead cam internal combustion engine having a low mass moment of inertia about the pivot axis of the finger follower. These and other objects of the present invention may be more fully understood by reference to the following description.

SUMMARY OF THE INVENTION

The object of the present invention is achieved by locating the lost motion torsional spring device at the lash adjuster end of the finger follower, above the lash adjuster.

The lost motion torsional spring device has two helical spring parts which are coaxial with each other and mounted on the finger follower transverse to the long axis of the finger follower. Each of the helical parts has a long leg and a short leg.

In order to locate the lost motion torsional spring device above the lash adjuster at the lash adjuster end of the finger follower, lost motion spring pins and a lost motion spring stop are provided to the outer housing of the finger follower to secure the lost motion torsional spring device on the finger follower and lost motion spring pallets are located on the inner housing in which the cam follower is housed. The lost motion torsional spring device is mounted on the outer housing by positioning one of each of the helical parts on one of each of the pins. The pallets provide a contact surface for the long legs while the stop provides a contact surface for the short legs. The short legs can be joined such that the lost motion torsional spring device is a single spring or the short legs can be separate such that the two helical parts form two separate springs.

Broadly, the switchable roller finger follower of the present invention can be defined as follows:

- an outer elongated body having a valve stem end, a lash adjuster end, and two outer elongated body side walls;
- a first inner cavity in said outer elongated body;
- two lost motion spring pins attached to said lash adjuster end of said outer elongated body, said pins oriented transversely to a long axis of the outer elongated body;
- a lost motion spring stop located on an outer wall of the elongated body and adjacent to said lash adjuster end;
- an inner elongated body positioned in said first inner cavity and having a first end pivotally attached to said outer elongated body at said valve stem end, a second end adjacent to said lash adjuster end, and two inner elongated body side walls;
- a second inner cavity in said inner elongated body;
- two lost motion spring pallets, one of each of said pallets fixed on one of each of said inner elongated body side walls at said second end;
- a center cam follower in said second inner cavity;
- a latch assembly fixed to said outer elongated body at said lash adjuster end for preventing pivoting of the inner elongated body; and
- a lost motion torsional spring device having two helical parts, one of each of said helical parts on one of each of said lost motion pins, each of said helical parts having a short leg and a long leg, the short leg of each of said helical parts abutting said stop and the long leg of each of said helical parts abutting one of said pallets.

The pallets and the long leg of the helical parts have mutual contact surfaces. It is preferred that these contact surfaces are convex and, more preferably, one or more of the contact surfaces is involute. Involute surface allows the surfaces to roll with each other rather than slide on each other. The rolling motion reduces spring wear and increases the life of the parts. Furthermore, by using the long leg and a pallet arrangement of the present Invention, the point of contact between the leg and the pallet can be varied. This means that the longer the leg the smaller the angular deflection of spring, which increases the life of the spring.

Preferably, the contact surface of the long leg of each of the helical parts is in rolling contact with the contact part of each of the pallets.

The inside wall of the outer elongated body side wall preferably has a recess which accommodates the movement of the pallets.

The pallets are preferably finger shaped, one side of which is curved and provides a contact surface.

The contact point between the pallets and the long leg of the helical part can be varied in location by varying the position of the pallet on the side wall of the inner elongated body and the length of the long leg so as to change the gear ratio.

The long leg of the helical part extends outward from the helical part and is transverse to the axis of helical part and parallel to the long axis of the outer elongated body. The short legs of the helical parts can be either connected to each other to form a bridge that abuts the stop or the short legs are not connected and each short leg abuts the stop.

If the short legs are not connected then two stops can be employed, one for each short leg.

Preferably, the bridge formed by the short legs is transverse to the long axis of the outer elongated body and parallel to the axis of the helical parts. Preferably, when the short legs are not connected, the short legs extend outward from the helical parts, transversely to the axis of the helical part and parallel to the long axis of the outer elongated body.

These and other aspects of the present invention may be more fully understood by reference to one or more of the following drawings and the detailed description thereof.

DETAILED DESCRIPTION OF THE DRAWINGS

Figure 5:
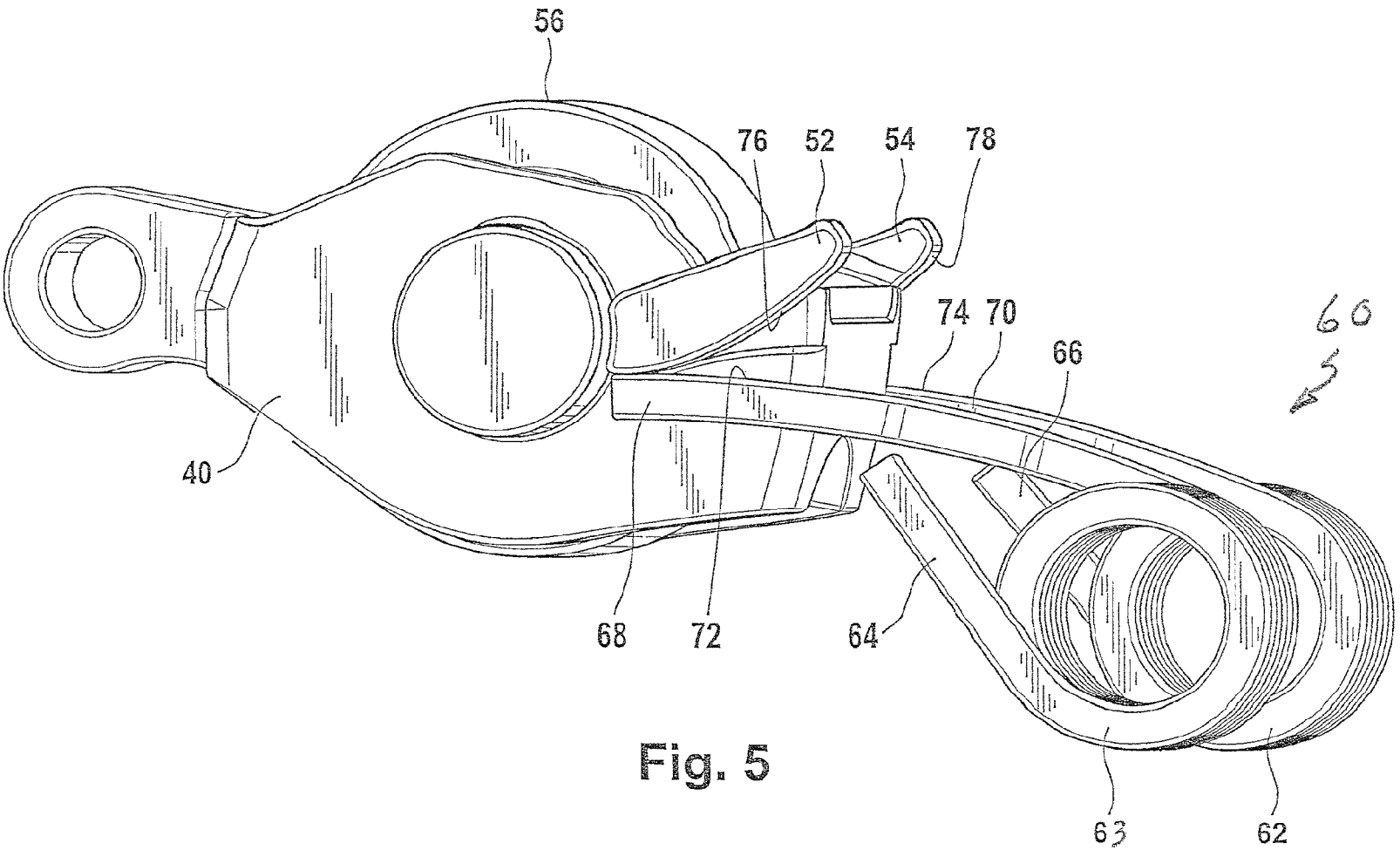
FIGS. 5 and 6 illustrate the motion of the inner elongated body and the cam follower of the finger follower of FIG. 1 when acted upon by the cam and when the latch is in the unlatched state.
Figure 6:
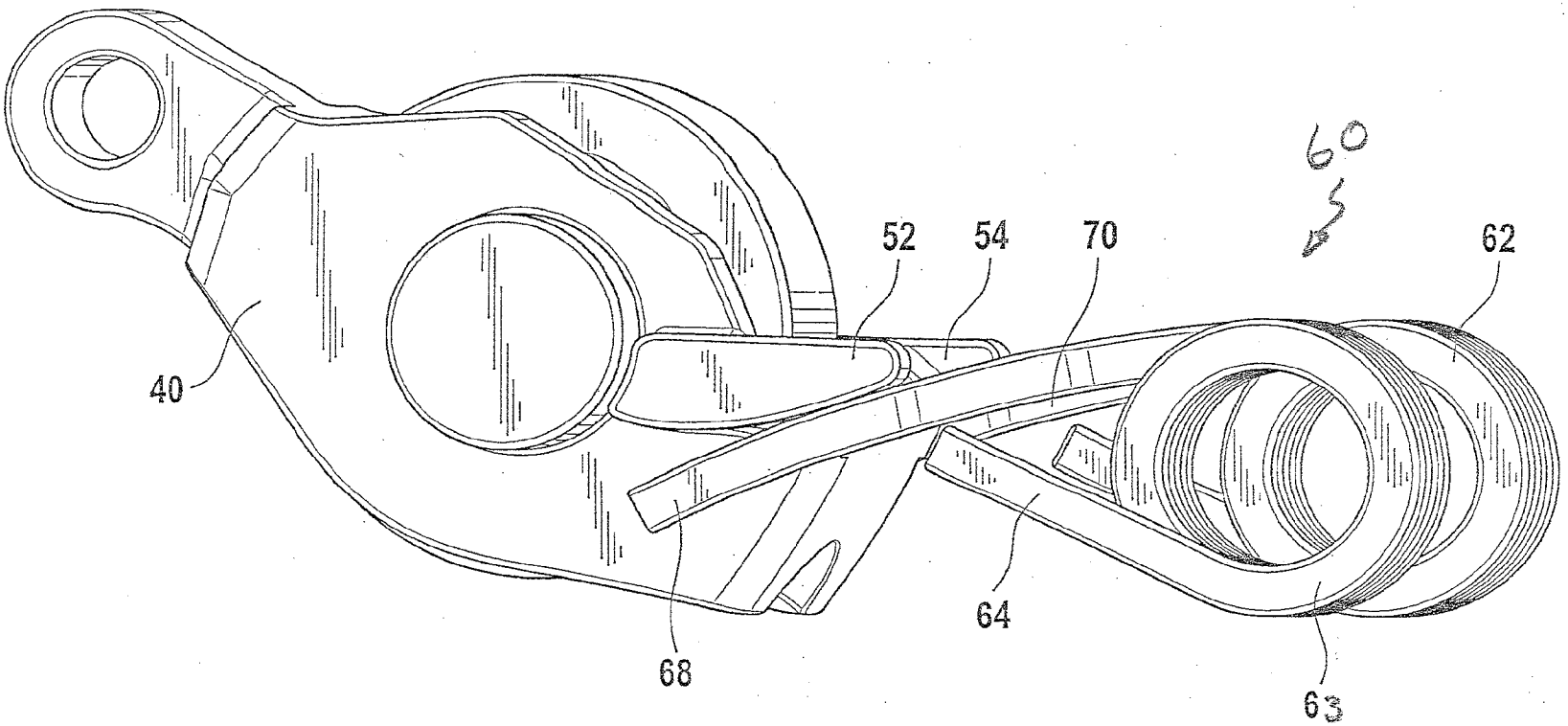
Figure 7:
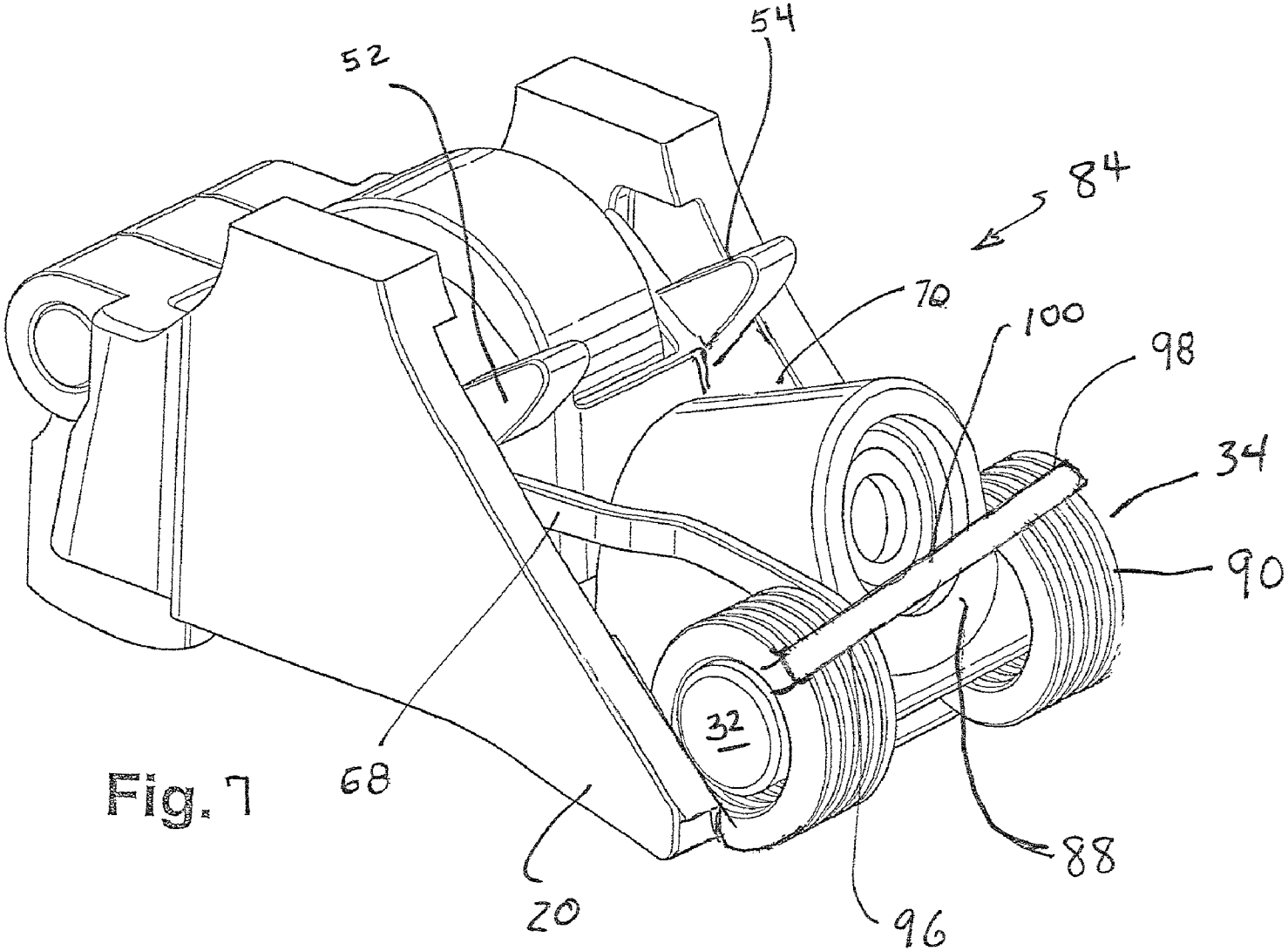
FIG. 7 illustrates a finger follower with a lost motion torsional spring device with two connected helical parts.

FIGS. 1-6 illustrate finger follower 10 with lost motion torsional spring device 60 having two separate helical parts 62, 63, while FIG. 7 illustrates finger follower 84 with lost motion torsional spring device 90 with short legs 96 and 98 joined by bridge 100 and outer elongated body 86 with stop 88.

Figure 1:
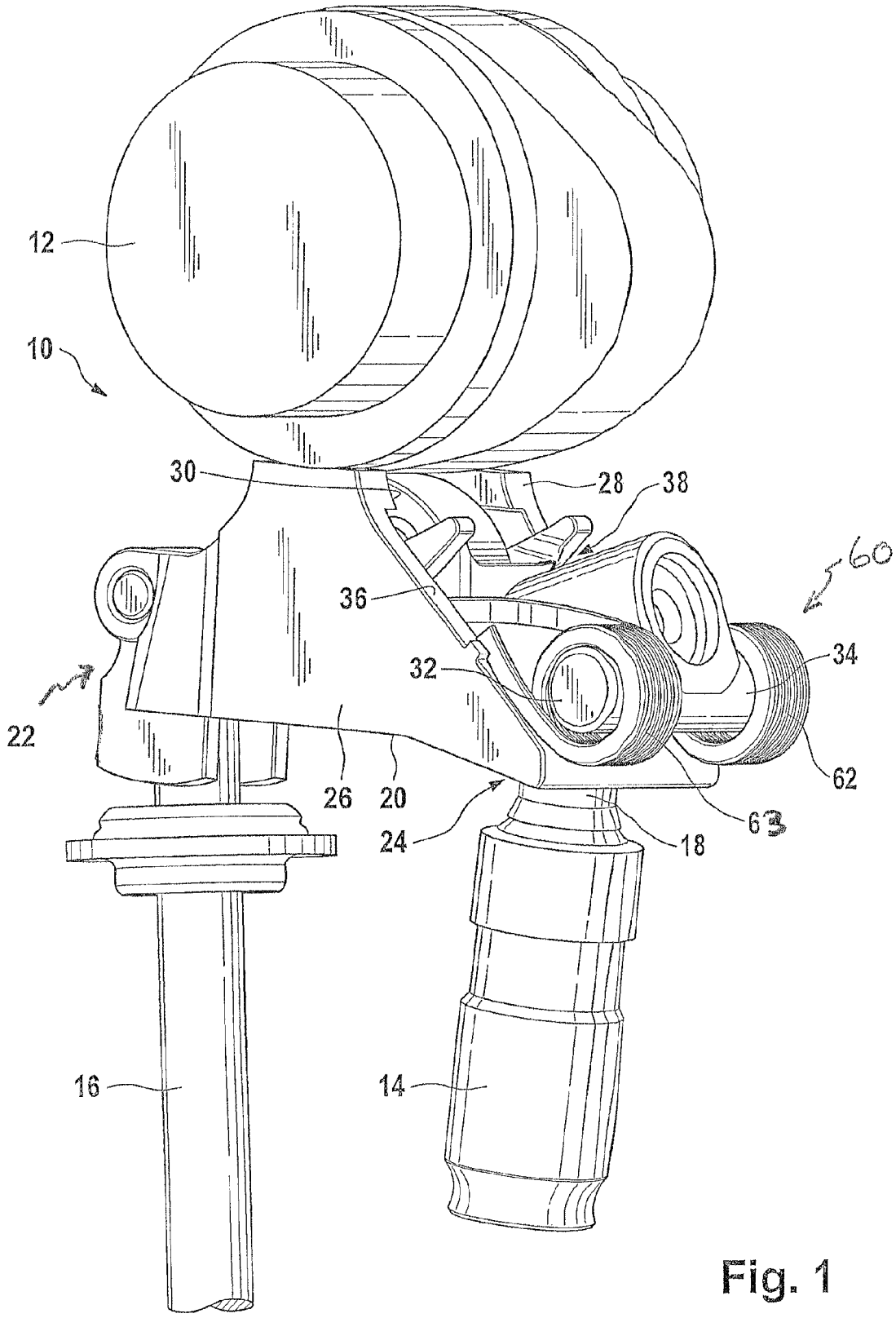
FIG. 1 illustrates a finger follower of the present invention with the valve stem, the cam, and the lash adjuster with a lost motion torsional spring device having two separate helical parts.

FIG. 1 illustrates finger follower 10 which is acted on by cam 12. Finger follower 10 pivots and is in contact with lash adjuster 14. Finger follower 10 through its pivot action operates on valve stem 16 to open and close the valve in a cylinder of an internal combustion engine (not shown). Finger follower 10 has pivot point 18, which is the point of contact between finger follower 10 and lash adjuster 14.

Finger follower 10 comprises an outer elongated body 20 having a valve stem end 22, a lash adjuster end 24, and two elongated body side walls 26 and 28.

First inner cavity 30, in outer elongated body 20, is defined by valve stem end 22, lash adjuster end 24 and side walls 26 and 28. Affixed to outer elongated body 20, at its lash adjuster end 24, are lost motion spring pins 32 and 34. Each of the side walls 26 and 28 provide lost motion spring stops 36 and 38.

Figure 2:
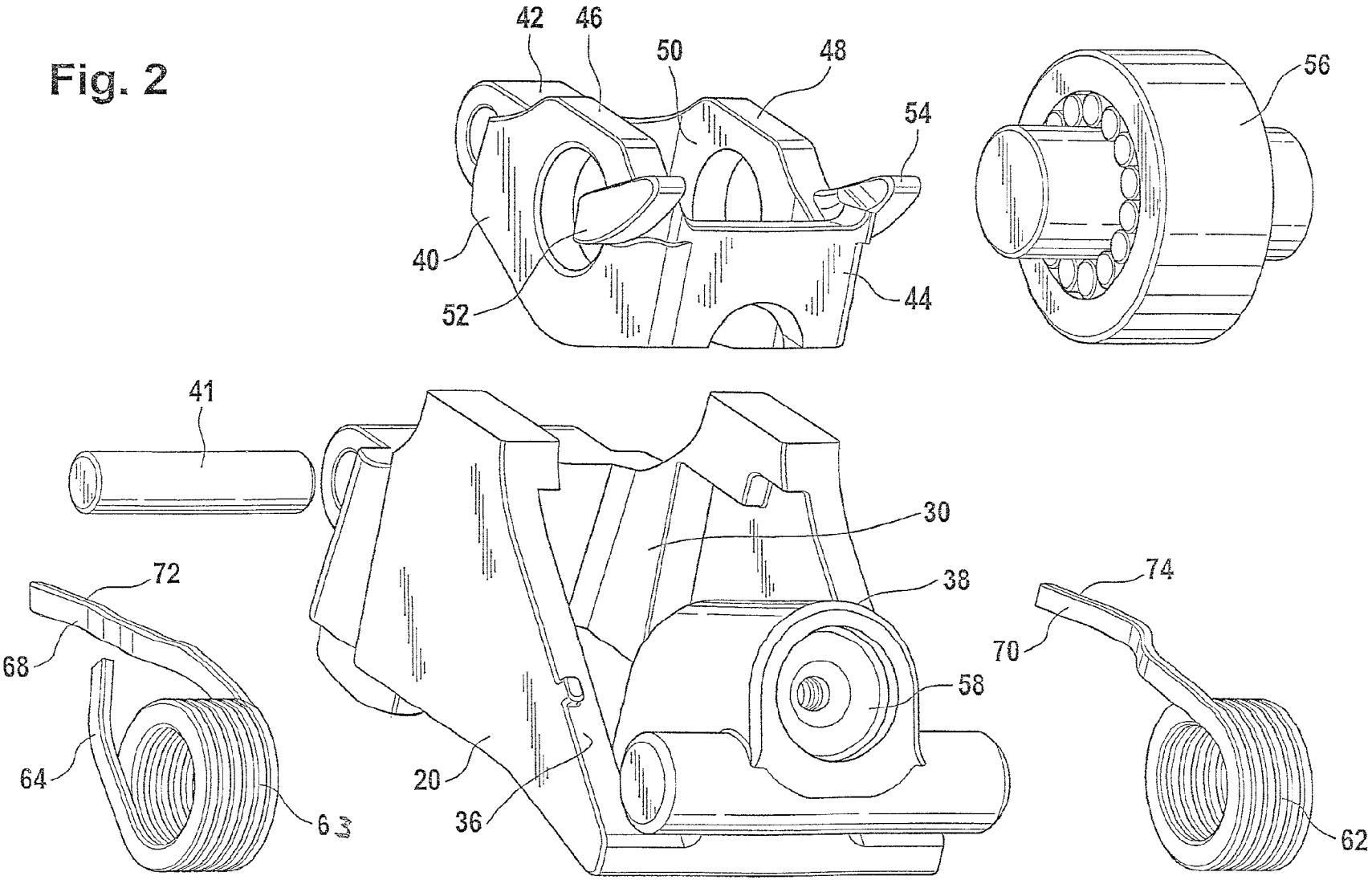
FIG. 2 is an exploded view of the finger follower of FIG. 1.
Figure 3:
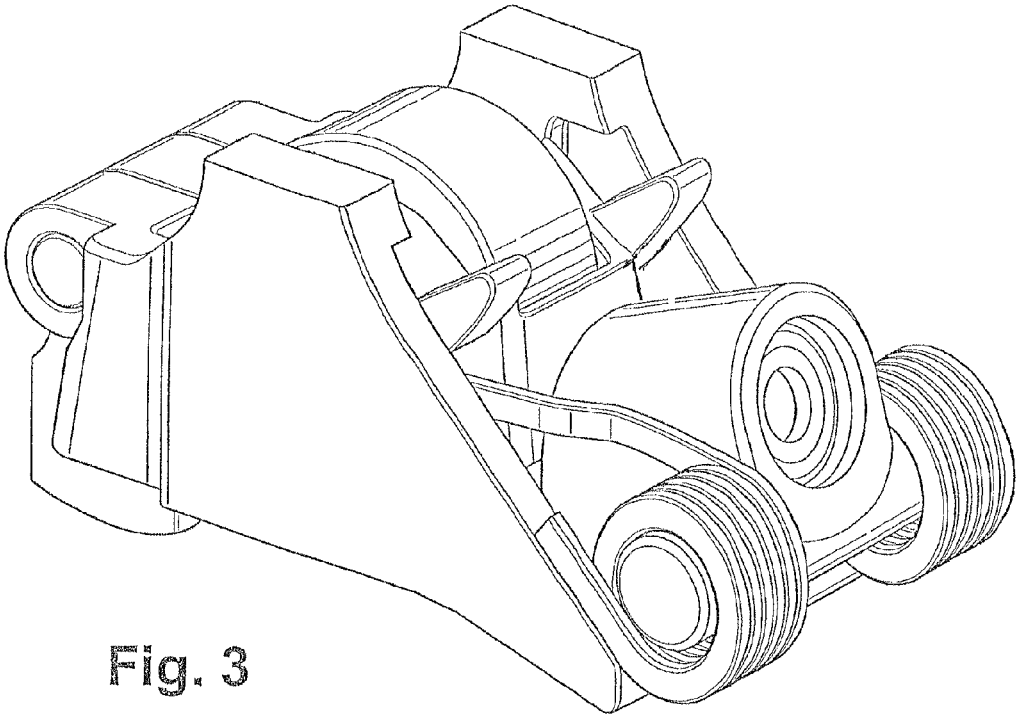
FIGS. 3 and 4 illustrate the action of the lost motion torsional spring device of the finger follower of FIG. 1 when the cam acts on the cam follower and the latch assembly has not been latched.

As shown in FIG. 2, inner elongated body 40 is positioned in first inner cavity 30. Inner elongated body 40 has a first end 42 which is pivotally attached to the valve stem end 22 of outer elongated body 20, by pin 41 a second end 44 which is adjacent to lash adjuster end 24 and two inner elongated side walls 46 and 48. Second inner cavity 50 is located in inner elongated body 42 and is defined by first end 42, second end 44 and side walls 46 and 48.

Two lost motion pallets 52 and 54 are affixed to side walls 46 and 48.

A center cam follower 56 is mounted in second inner cavity 50.

Latch assembly 58 forms part of outer elongated body 20. Latch assembly 58 is a conventional latch assembly which is operated in a conventional manner in order to lock the inner elongated body 40 to outer elongated body 20.

Lost motion torsional spring device 60 has two helical parts 62 and 63 positioned on pins 32 and 34 respectively. Each helical part 62, 63 has a short leg 64 and 66 which abut lost motion spring stops 36 and 38 respectively. Long legs 68 and 70 of helical parts 62, 63 extend into first inner cavity 30 and abut pallets 52 and 54 respectively.

As can be seen in FIGS. 5 and 6, long legs 68 and 70 have contact surfaces 72 and 74. Contact surfaces 72 and 74 are each convex, and, more preferably are involute.

Pallets 52 and 54 have contact surfaces 76 and 78. Contact surfaces 76 and 78 are convex, and more preferably, involute. Contact surface 72 contacts contact surface 76 and contact surface 74 contacts contact surface 78.

Figure 4:
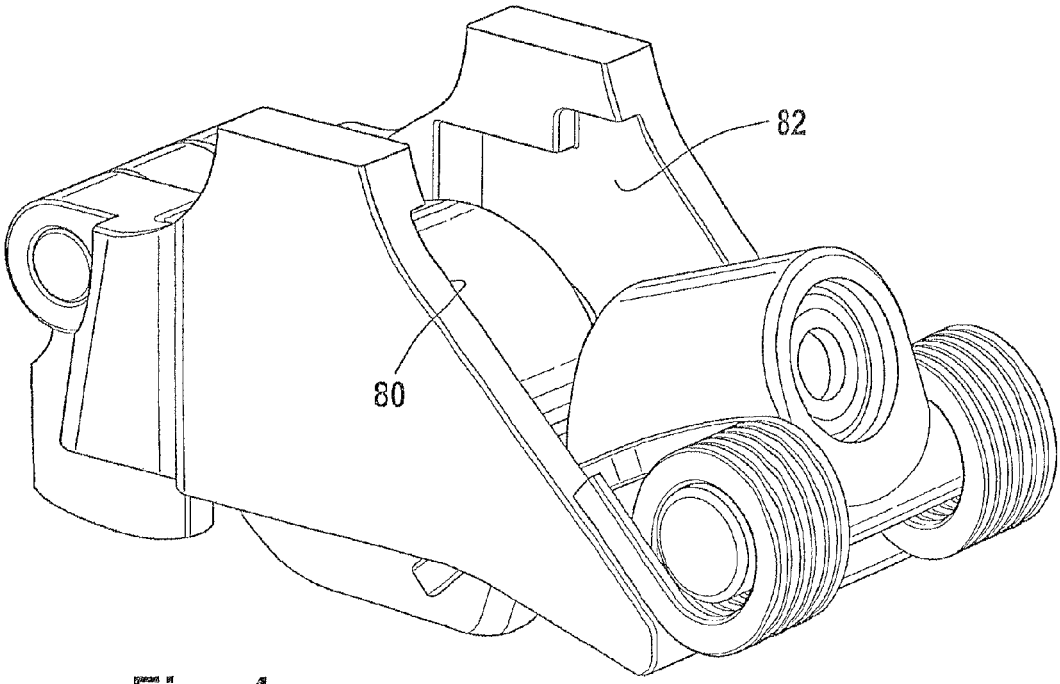

As can be seen in FIG. 4 both side walls 26 and 28 have recesses 80 and 82, respectively. Recesses 80 and 82 provide clearance for the movement of pallets 52 and 54 as inner elongated body 40 pivots about its first end 42. This pivoting action is visible in FIG. 3 and FIG. 4.

The interaction between contact surfaces 72, 74, 76, and 78 are shown in FIGS. 5 and 6. It is preferred that each of the contact surfaces are convex so that they do not interfere with one another, and more preferably, the contact surfaces are involute such that the contact between the surfaces 72-76 and 74-78 is a rolling contact not a sliding contact.

Lost motion springs 60 is positioned above the pivot point of finger follower 10.

Preferably, pallets 52 and 54 are molded as part of inner elongated body 40. Contact surface 76 to 78 can be specially treated to provide for good reduced wear between contact surfaces 72 and 74.

Turning to FIG. 7, finger follower 84 has outer elongated body 20 with lost motion spring stop 88. Lost motion torsional spring device 90 has helical parts 92 and 94 mounted on pins 32, 34 respectively. Short legs 96 and 98 are joined to form bridge 100. Bridge 100 abuts stop 88. Long legs 68, 70 of helical parts 92, 94 abut pallets 52, 54 of inner elongated body 40. As can be seen, spring 90 is similar to spring 60, except the orientation of short legs 96, 98 and the inclusion of bridge 100. It is noted that stop 88 is the end of laten assembly 58, but latch assembly 58 does not extend outward from body 20, thus, bridge 100 does not interfere with the action of latch assembly 58.

It will be noted that by locating lost motion torsional spring device 60, 90 above pivot point 18, less weight is provided above the valve stem. Also, by positioning lost motion torsional spring device above the pivot point, the mass motion of inertia about the pivot point is improved.

Suitable lost motion torsional spring device are sized for the dynamic loads required by the system to maintain cam contact, based on the hinge point and mass moment of inertia of the system.

Alternatively, it will be seen that the contact point or points between long legs 68, 70 and pallets 52, 54 can be moved to increase or decrease the length of legs 68, 70 and the point where contact is made. The longer the length of legs 68, 70, the less angular displacement of spring device 60, 90 and the less weary and longer life of spring device 60, 90. To move the contact point farther away from lash adjuster end 24, pallets 52 and 54 are moved on side wall 46, 48 towards end 42 of inner body 40, while still maintaining the rolling contact between surfaces 72, 74, 76, 78. This effects the gear ratio of the follower.

Although only a limited number of specific embodiments of the present Invention have been expressly disclosed, it is, nonetheless, to be broadly construed and not to be limited except by the claims appended hereto.

REFERENCE CHARACTERS

10 Finger follower
12 cam

14 lash adjuster
16 valve stem
18 pivot point of finger follower
20 outer elongated body
22 valve stem end
24 lash adjuster end
26 side wall
28 side wall
30 first inner cavity
32 pins
34 pins
36 lost motion spring stop
38 lost motion spring stop
40 inner elongated body
41 pin
42 first end of inner elongated body
44 second end of inner elongated body
46 side wall
48 side wall
50 second inner cavity
52 pallet
54 pallet
56 center cam follower
58 latch assembly
60 lost motion torsional spring
62 helical spring part
63 helical spring part
64 short leg
66 short leg
68 long leg
70 long leg
72 contact surface of leg
74 contact surface of leg
76 contact surface of pallet
78 contact surface of pallet
80 recess
82 recess
84 finger follower
88 lost motion spring stop
90 lost motion torsional spring
92 helical spring part
94 helical spring part
96 short leg
98 short leg
100 bridge

The invention claimed is:

1. A switchable roller finger follower comprising:

an outer elongated body having a valve stem end, a lash adjuster end and two outer elongated body side walls;

a first inner cavity in said outer elongated body;

two lost motion spring pins attached to said lash adjuster end of said outer elongated body, said pins oriented transversely to a long axis of said outer elongated body;

a lost motion spring stop located on an outer wall of said elongated body and adjacent said lash adjuster end;

an inner elongated body positioned in said first inner cavity and having a first end pivotally attached to said outer elongated body at said valve stem end a second end adjacent said lash adjuster end of said outer elongated body and two inner elongated body sidewalls;

a second inner cavity in said inner elongated body;

two lost motion spring pallets, one of each of said pallets fixed on one of each of said inner elongated body side walls and adjacent said second end of said inner elongated body;

a center cam follower in said second inner cavity a latch assembly for preventing pivoting of the inner elongated body; and a lost motion torsional spring device having two helical parts, one of each of said helical parts on one of each on said lost motion pins, each of said helical parts having a short leg and a long leg, the short leg of each of said helical part abutting said stop and the long leg of each of said helical part abutting one of said pallets.

2. The follower of claim 1 wherein said long leg of each of said helical parts has a contact surface and each of said pallets has a contact surface and said contact surface of said long leg contacts said contact surface of said pallets.

3. The follower of claim 2 wherein said contact surface of each of said pallets is convex.

4. The follower of claim 2 wherein said contact surface of said long leg of each of said helical parts is convex.

5. The follower of claim 2 wherein said contact surface of each of said pallets is convex and said contact surface of said long leg of each of said helical parts is convex.

6. The follower of claim 2 wherein said contact surface of each of said pallets and said contact surface of said long leg of each of said helical parts is involute.

7. The follower of claim 2 wherein said contact surface of said pallet are in rolling contact with said contact surface of said long leg of each of said helical parts is convex.

8. The follower of claim 1 wherein each of said pallets is mounted on an outside surface of said inner elongated body side wall.

9. The follower of claim 1 further comprising a recess in an inside surface of each of said outer elongated body sidewalls for accommodating movement of said pallets.

10. The follower of claim 1, wherein said short legs are connected to form a bridge and the bridge abuts the stop.

11. The follower of claim 10, wherein said outer elongated body has an end wall at said lash adjuster end, said end wall is transverse to said outer elongated body side walls, and said stop is on said end wall.

12. The follower of claim 1, wherein said short legs are separate from each other;

said stop is formed from two steps, one of each of said two stops on said outer elongated body side walls; and one of each of said short legs abutting one of each of said stops.

13. The follower of claim 2, wherein the contact surface of the long legs is changed by changing the length of the long leg and the position of the pallet on the side wall of the inner body so as to change the gear ratio.

* * * * *